United States Patent [19]

Dietrich

[11] 3,979,120

[45] Sept. 7, 1976

[54] RESTORABLY DEFORMABLE HOCKEY GOAL

[76] Inventor: John Stuart Dietrich, c/o Harold Bick, Barrister and Solicitor, 905 Metro Trust, Windsor, Ontario, Canada

[22] Filed: Dec. 2, 1974

[21] Appl. No.: 528,918

[52] U.S. Cl. ..... 273/127 B; 403/229

[51] Int. Cl.[2] ..... A63B 63/00

[58] Field of Search ..... 273/127 R, 127 B, 26 A, 273/1 B; 403/118, 129, 220, 223, 229, 291; 46/27, 28, 29

[56] References Cited

UNITED STATES PATENTS

| | | | |
|---|---|---|---|
| 1,013,410 | 1/1912 | Lynch | 403/229 |
| 2,283,607 | 5/1942 | Ludwig | 403/229 X |
| 2,439,921 | 4/1948 | Brown | 403/229 X |
| 2,449,708 | 9/1948 | Lindsay | 273/127 B |
| 2,765,580 | 10/1956 | Herrschaft | 403/223 X |
| 3,507,069 | 4/1970 | Borba, Sr. | 403/229 X |
| 3,642,282 | 2/1972 | Frischman | 273/127 B |
| 3,698,715 | 10/1972 | Browning et al. | 273/127 B |

FOREIGN PATENTS OR APPLICATIONS

| | | | |
|---|---|---|---|
| 397,209 | 3/1948 | France | 403/229 |

*Primary Examiner*—Richard C. Pinkham
*Assistant Examiner*—T. Brown
*Attorney, Agent, or Firm*—Michael M. Sakovich

[57] ABSTRACT

A frame for supporting a games net includes a number of tubular frame members having threaded ends and a number of helical springs that are threadably connectable to the threaded ends to form a novel frame structure that is restorably deformable at the joined ends.

4 Claims, 5 Drawing Figures

RESTORABLY DEFORMABLE HOCKEY GOAL

BACKGROUND OF THE INVENTION

This invention relates to games nets and more particularly to games frames therefor having resilient connecting means for joining together structural members of the frames.

Games nets in various forms are widely used in both professional and amateur sports activities. Moreover, similar games nets of a less durable nature are commonly used in various amusement games activities, notably hockey.

A recognized problem in professional hockey is the fact that injuries frequently occur as a result of players being driven into or accidently falling against the frame of a goal net. In order to prevent such injuries hockey goal frames of a type having net support members which yield under impact have been proposed. Two such structures are shown in U.S. Pat. Nos. 2,449,708, and 2,525,304. The former Patent describes a hockey goal structure having a coil spring wrapped around a pair of rigid end supports which are pivotally joined together. In this structure, the coil spring returns the rigid supports to an upright position in the event that such supports are buckled about the pivot joint when struck as by a falling player. One apparent problem with this structure is that this buckling action occurs only when an impact blow is delivered from a frontal direction. In the event that a player should strike the goal structure from a rearward direction or from one side the goal will not buckle. The latter patent is directed to a hockey goal structure having rigid supporting members wherein the entire structure tends to collapse on impact. The original form of the structure is restored through the use of fluid-filled shock absorbers and return springs. An apparent problem with this structure is the fact that the goal net will not collapse with equal ease when receiving omnidirectional impacts. Moreover, the structure tends to be complicated and therefore expensive to manufacture.

The foregoing hockey goals tend to be unsuitable for use in entertainment games for children by reason of the complexity in assembling such structures and primarily because of the cost factor which tends to make such goals prohibitively expensive as games devices. As a result, the goals commonly used by children at play do not provide safety features of a type in which the frame will resiliently collapse on impact. Accordingly, children are required to rely upon pads, helmets and like shock absorbing gear for protection. It is apparent therefore that unless children's games activities are rigorously supervised, it is likely that serious injuries may occur should a child accidently fall into or be pushed against a hockey goal frame that is rigidly assembled and which may be fixedly attached to a games court or ice rink.

SUMMARY OF THE INVENTION

A principal object of the present invention is to provide a games frame of a type that is readily assembled and disassembled and when assembled, provides a structure that is resiliently deformable from substantially any angle of impact.

A further object of the present invention is to provide a goal frame structure that combines ecomony of manufacture with safety in use so as to fulfill an equal requirement for safety in both professional and amateur sports as well as in children's games.

The foregoing objectives may be achieved by recourse to the present invention which is a restorably deformable games net frame for supporting a mesh net. The frame comprises a plurality of rigid tubular frame members having internally threaded ends that are interconnectable to form the frame and a plurality of resilient helical springs flexibly interconnecting corresponding pairs of the ends, each spring having a center portion of uniform diameter substantially equal to the outside diameter of the members and an end portion on each side of the center portion, the end portions having an outside diameter and helical pitch adapted to threadably join a corresponding pair of the ends into abutting relation with the center portion to provide a substantially smooth and continuous flexible joint that is resilient and permits restorably displaceable movement between each corresponding pair of joined frame members.

DESCRIPTION OF THE DRAWINGS

The invention will now be more particularly described with reference to an embodiment thereof shown by way of example in the accompanying drawings in which.

DESCRIPTION OF THE PREFERRED EMBODIMENT

Figure 2:
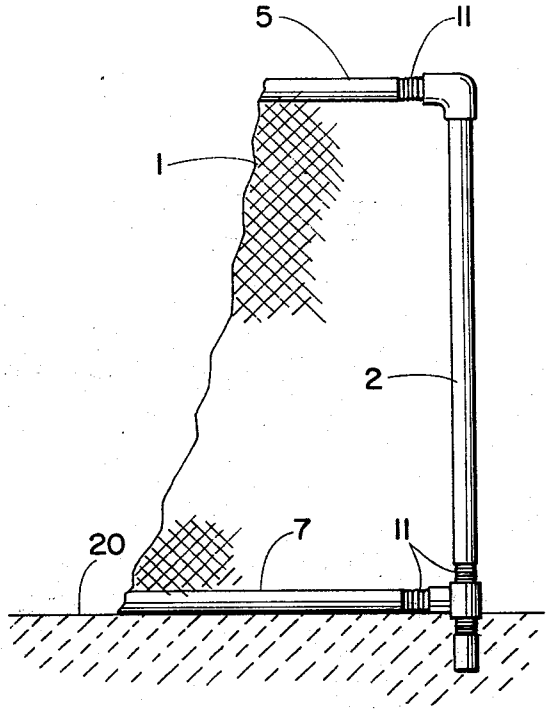
FIG. 2 is a side elevation view of the goal structure of FIG. 1.
Figure 1:
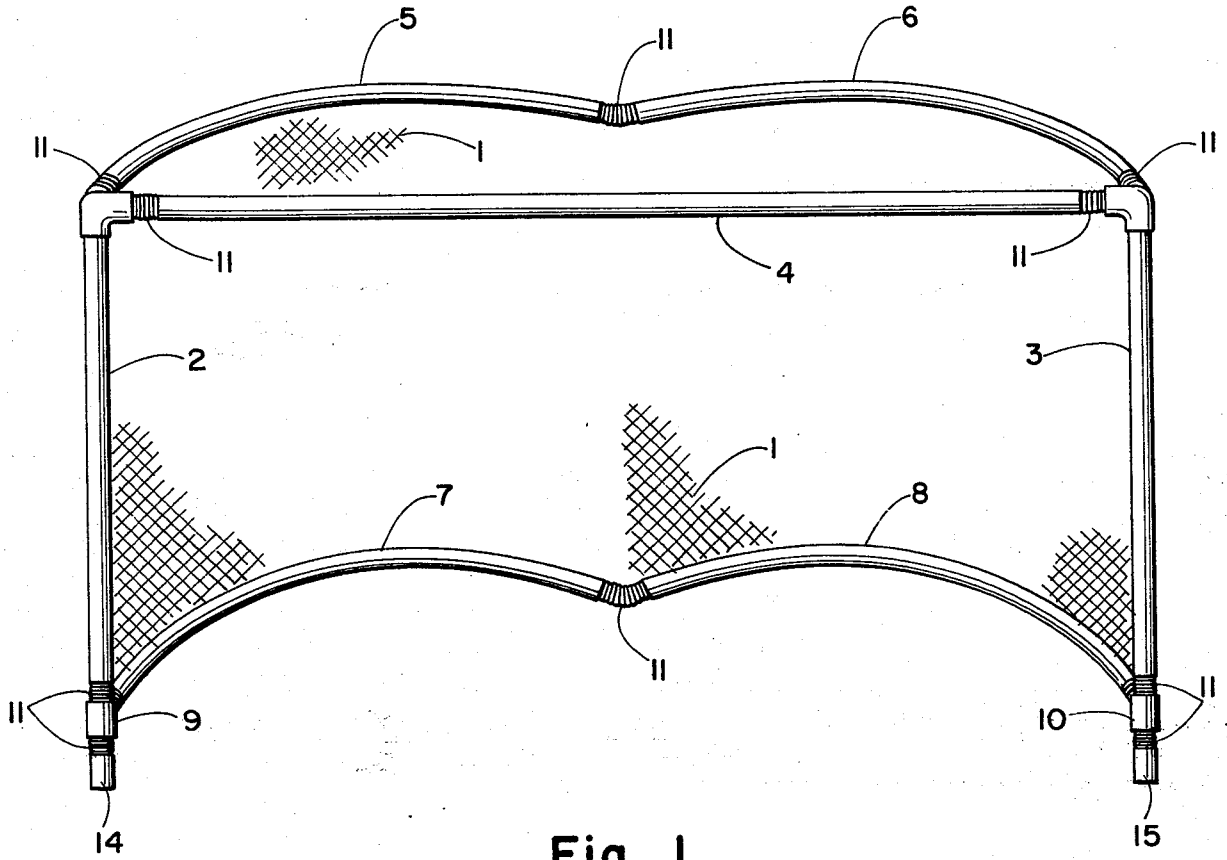
FIG. 1 is a perspective view of a collapsible goal structure in accordance with the present invention.

A perspective view of a hockey goal in FIG. 1 clearly shows a common configuration of structural members that are assembled to form a frame to which a net 1 is attached. The frame of the goal net structure comprises a plurality of frame members shown as steel tube pieces suitably formed to provide a required shape. In the figures, the frame members are made from standard steel tubing and comprise a first vertical support member 2 and a second vertical support member 3 which are spaced apart and are joined transversely at their upper ends by a transverse top member 4. The combination of these three tubes defines the entrance to the goal.

The frame of the goal structure is given depth by means of a first curved top member 5 that is joined to a like second curved top member 6. The free ends of both members 5 and 6 are connected to the upper ends of support members 2 and 3 respectively and extend rearwardly from the frame entrance. In addition, there is provided a first curved base member 7 and a second curved base member 8 which are joined together in like manner. The members 7 and 8 have free ends that are joined to a first anchor member 9 and a second anchor member 10, respectively, and extend rearwardly from the entrance of the frame. In this position, members 7 and 8 also act to support and stabilize the frame when it is placed on a flat surface such as the ice 20 surface of a hockey rink. The lower ends of the vertical support members 2 and 3 are also joined to the anchor members 9 and 10, respectively, to provide a unitary frame structure.

Figure 4:
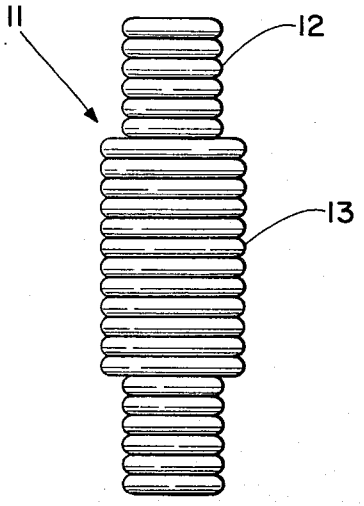
FIG. 4 is a side elevation view of a resilient joining member for joining the structural members of a goal structure.
Figure 5:
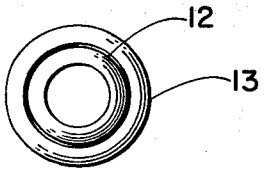
FIG. 5 is an end view of the resilient joining member of FIG. 4.
Figure 3:
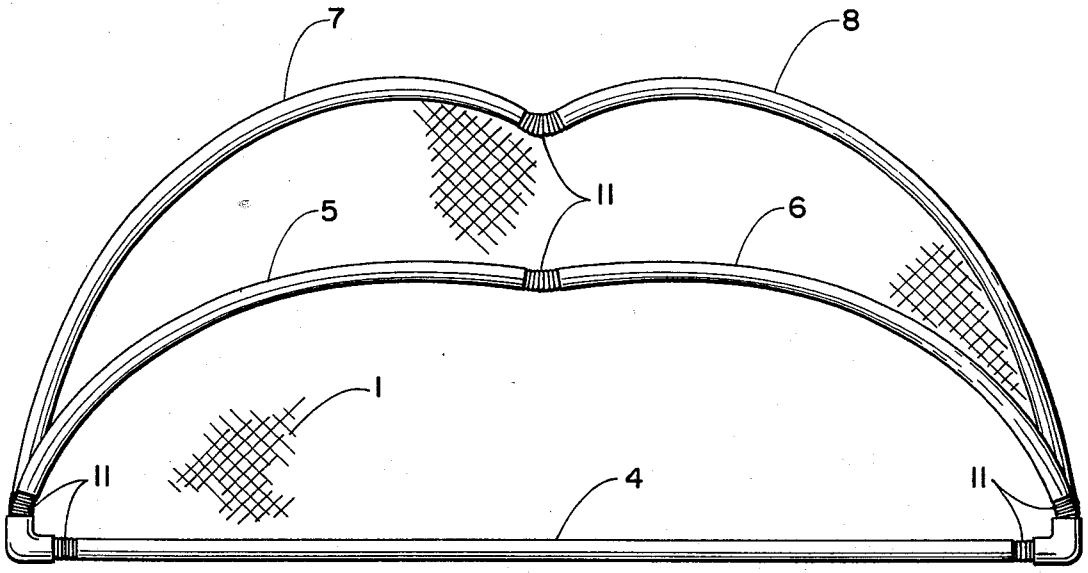
FIG. 3 is a top plan view of the goal structure of FIG. 1.

The frame in the figures is given a resilient quality by means of a resilient joining member shown in the figures, and particularly in FIGS. 4 and 5, as a coil spring connector 11. A connector 11 is used between each pair of corresponding frame member ends that are to be flexibly joined. To join the ends, the end portions of the steel tube pieces are each threaded internally and a helical spring connector 11 is screwed therein to provide a resilient connection therebetween. As an alternative, the connector 11 may be adapted to threadably engage the outer wall of a suitably threaded tube end.

The spring connector 11 is shown in greater detail in FIGS. 4 and 5. It may be seen therein that the connector 11 is formed as a unitary coil spring having two diameters 12 and 13. The diameter 12 is smaller than diameter 13 and is sized to fit the internal threads in the end portions of the frame members whereas the larger diameter 13 is of a size substantially the same as the outside diameter of the frame members to provide a substantially smooth and continuous joint at each junction point. However, if the connector 11 is adapted to threadably engage the outer wall of a suitably threaded tube end then the internal diameter of the diameter 12 portion is sized to fit the external threads of the threaded tube end.

In order to anchor the frame solidly and in a resilient manner, the spring connectors 11 may be used to join the anchor members 9 and 10 to a pair of corresponding anchors 14 and 15 which may be set in the supporting surface for the frame. In the case of a hockey rink, such anchors could be set into the ice 20. Thus, in the event that the goal of the present invention receives an impact, the frame members may be laterally displaced in a resilient manner at each connector 11, returning to their original respective positions when the impact force is removed. In this way, the probability of injury to a player is reduced as a result of the impact force being absorbed by the resilient movement in a shear direction of one or more connectors 11.

Although the foregoing description has been made with particular reference to a hockey goal, it should be understood that the spirit and scope of the present invention is not restricted to hockey goals per se but includes games goals generally in which a resilient and easily assembled frame structure is required. Thus, the invention may find application in other game goals structures such as baseball back stops. Equal application may also be found in games requiring a goal frame not having a net portion such as goal frames used in football and soccer.

What I claim is:

1. A restorably deformable hockey goal frame, comprising:

a plurality of rigid tubular frame members having internally threaded ends that are interconnectable to form the frame, said members including, a pair of straight upstanding tubes spaced apart in substantially parallel relation;

a straight upper tube disposed transversely between and joining first upper end portions of the upstanding tubes, the combination of the three tubes defining a goal entrance;

a pair of curved upper tubes joined together at one end and having their free ends joined to corresponding second upper end portions of the upstanding tubes, the curved portions of said curved upper tubes extending rearwardly from the goal entrance;

a first pair of anchor members each having oppositely disposed first and second ends and a third end perpendicular thereto, the first ends being joined to respective ones of the lower ends of the upstanding tubes; and a pair of curved base tubes joined together at one end and having their free ends joined to respective ones of the third ends of said anchor members, the curved portions of said base members extending rearwardly from the goal entrance;

and;

a plurality of resilient helical springs, individual ones of which flexibly interconnect the joined corresponding pairs of said ends, each spring having a center portion of uniform diameter substantially equal to the outside diameter of the members and an end portion on each side of the center portion, the end portions having an outside diameter and helical pitch adapted to threadably join a corresponding pair of said ends into abutting relation with the center portion to provide a substantially smooth and continuous flexible joint that is resilient and permits restorably displaceable movement between each corresponding pair of joined frame members.

2. A hockey goal frame as claimed in claim 1 further comprising a net having a first portion secured to the straight upper tube and the curved upper tubes and a second portion secured to the curved upper and base tubes and to the upstanding tubes.

3. A hockey goal frame as claimed in claim 2 further comprising a second pair of anchor members each having oppositely disposed first and second ends, the first ends being joined to respective ones of the second ends of said first pair of anchor members and the second ends of said second pair of anchor members being adapted to be set into an ice surface.

4. A hockey goal frame as claimed in claim 3 wherein the tubes are formed of steel.

* * * * *